United States Patent [19]

Langendorfer, Jr. et al.

[11] 4,244,273

[45] Jan. 13, 1981

[54] RIFLE MODIFICATION

[75] Inventors: Walter J. Langendorfer, Jr., Lansdowne; David W. Coffin, Sr., Prospect Park, both of Pa.

[73] Assignee: Langendorfer Plastics Corporation, Lansdowne, Pa.

[21] Appl. No.: 965,983

[22] Filed: Dec. 4, 1978

[51] Int. Cl.[3] ..... F41D 5/10

[52] U.S. Cl. ..... 89/193; 89/198

[58] Field of Search ..... 89/185, 191 R, 193 198; 42/49 A

[56] References Cited

U.S. PATENT DOCUMENTS

| | | | |
|---|---|---|---|
| 2,951,424 | 9/1960 | Stoner | 89/179 X |
| 3,366,011 | 1/1968 | Sturtevant | 89/198 |
| 3,417,660 | 12/1968 | Harbrecht | 89/198 |
| 3,675,534 | 7/1972 | Beretta | 89/191 X |
| 3,776,095 | 12/1973 | Atchisson | 42/49 A X |
| 3,869,961 | 3/1975 | Kawamura | 89/198 X |
| 3,982,468 | 9/1976 | Browning | 89/198 X |
| 4,095,507 | 6/1978 | Close | 89/191 R X |

FOREIGN PATENT DOCUMENTS

| | | | |
|---|---|---|---|
| 2019232 | 11/1970 | Fed. Rep. of Germany | 89/191 |

*Primary Examiner*—Peter A. Nelson

*Attorney, Agent, or Firm*—Eugene Chovanes; Edward Lovett Jackson

[57] ABSTRACT

A modification for the M-16 U.S. Army rifle wherein the bolt mechanism is activated by mechanical means instead of the present gas means.

1 Claim, 7 Drawing Figures

30
46
47
48
50
52
53
55
56
57
58
59
60
64
65
66
67
68
70
71
72
73
5.

71
72
73
75
76

46
47
50
51

35
36
41
42
43
64
66
69
70
71
72
73
75
76

RIFLE MODIFICATION

BACKGROUND OF THE INVENTION

The standard U.S. Army rifle is the well known M-16 Colt design rifle. Such rifle is fully described and shown in prior U.S. patents.

The rifle can be operated selectively as a semi-automatic rifle. In either operation, the propellant gases formed in the rifle are used to operate the bolt mechanism whereby the bolt is unlocked and then retracted. During retraction, the spent shell is ejected, and a helically wound spring is compressed. The bolt mechanism is then returned to its forward locked position by the spring.

The bolt is operated by the propellant gasses by tapping these gases in the rifle barrel prior to the bullet's leaving the barrel and by transmitting this gas pressure through an elongated tube extending along the top of the barrel to a position adjacent the bolt mechanism. This gas pressure is then used to move the bolt rearwardly slightly during which action the locking mechanism of the bolt is rotated, permitting the bolt to be forced fully rearwardly by direct action from the gases in the barrel, at which time the spent shell is ejected from the chamber of the rifle. Such action is well known.

PROBLEM OF THE PRIOR ART

In the operation as described above, it is critical that the passageway through which the gas pressure is transmitted from the barrel rearwardly to the vicinity of the bolt be kept open so that adequate pressure can be transmitted. In the M-16 this passageway or orifice extends for approximately 10". The diameter of the orifice is approximately 0.040".

A problem has arisen in the operation of this rifle, in that this passageway, and orifices leading to and away from this passageway, become clogged and blocked with a residue or products of combustion resulting from the ignition of the propellant powder used in the projectile. The problem is particularly acute when the propellant powder includes calcium carbonate. The U.S. Government, in an effort to solve the problem, has set high standards for the propellant powders in an attempt to eliminate the residues, particularly residues from calcium carbonate. However, the problem of obstruction or blockage of the orifice from residues, as well as outside particles, continues to occur, resulting in malfunction of the rifle.

The problem is a particularly serious one since the passageway is much longer than is generally the case in this type of design.

SUMMARY OF THE PRESENT INVENTION

The present invention eliminates the prior art problem of blockage of the passageway from residue in the products of combustion of the propellant, or from foreign particles.

In the present invention the long, relatively small diameter air passageway is eliminated and the force necessary to operate the bolt mechanism is transmitted by mechanical means rather than by the former gas pressure means. The mechanical movement consists essentially of a forward cylinder connected to the front portion of the barrel wherein gas pressure from the propellant powder is introduced. Pressure within the cylinder acts to operate a piston and rod which transmits force rearwardly to the bolt. A buffer arrangement is created between the rearward portion of the piston rod and the bolt key. This buffer arrangement between the piston rod and the bolt key serves to absorb the initial high impact created by the gases in the forward cylinder which is transmitted rearwardly by the piston rod.

The present invention can be used to modify existing rifles wherein the modified parts, suitably in the form of a kit, can be substituted or applied to existing rifles.

Additionally, new rifles can be built with the modifications therein.

The cylinder is suitably vented so that only a portion of the gas pressure is used to operate the recoiling piston rod.

DESCRIPTION OF THE SPECIFIC EMBODIMENT

Figures 1, 2, 3:
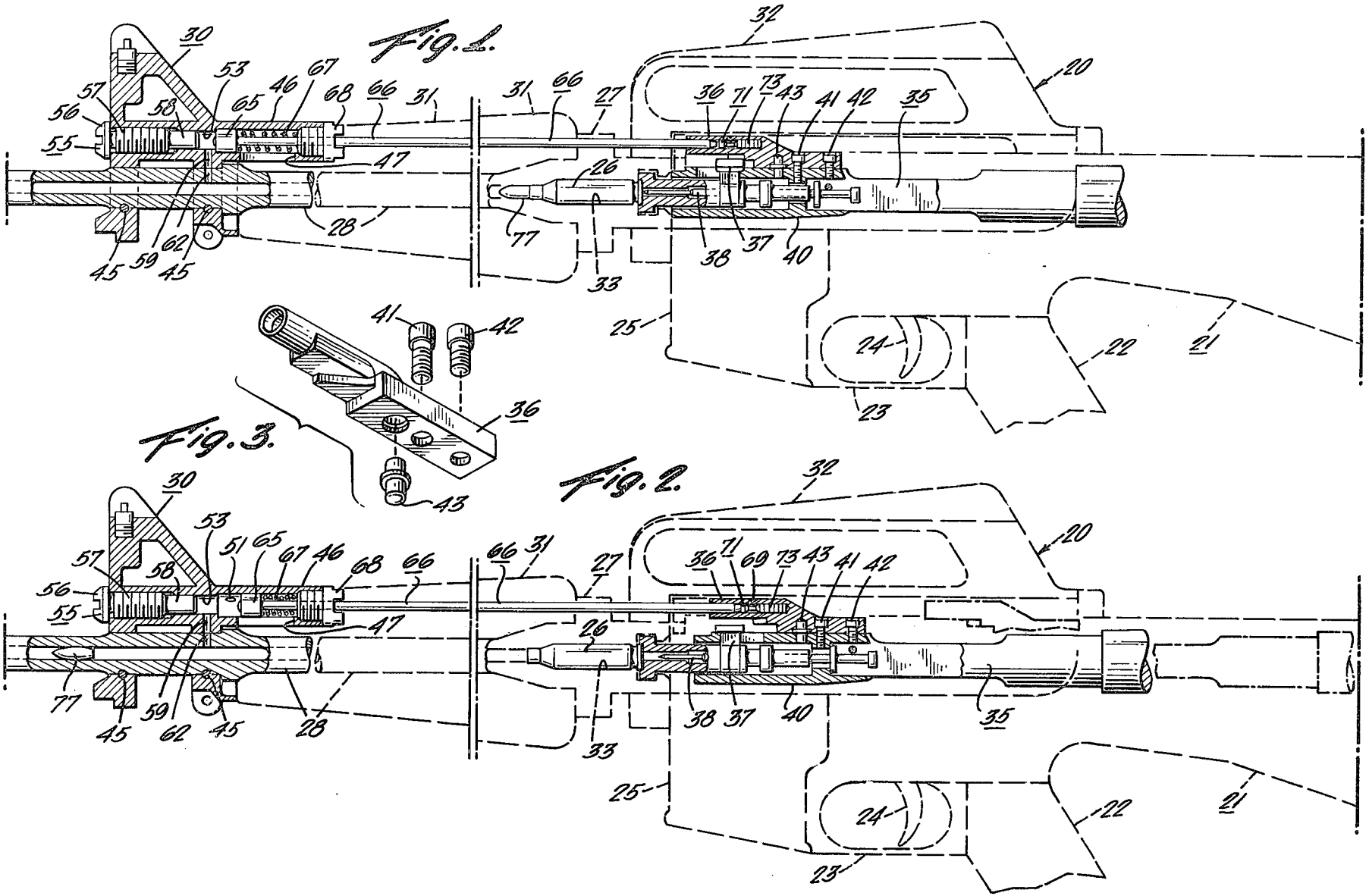
FIG. 1 is a side elevational view, in phantom lines, of an M-16 rifle, with the portions of the assembly pertinent to our invention shown in full lines.
FIG. 2 is a view similar to FIG. 1 showing the piston, piston rod, bolt carrier key and bolt assembly, immediately after firing, with the bullet having passed a vertically extending gas port in the front sight assembly.
FIG. 3 is a pictorial view of the bolt carrier key, fasteners and gas port plug and shear pin in exploded related positions, prior to assembly to the bolt.

There is shown in the figures a cut-away portion of a M-16 rifle 20 having therein a stock assembly 21 having integral therewith a pistol grip 22, trigger housing 23 and trigger 24 and magazine housing 25, all of the standard prior art design. Forward of the stock is the upper receiver 27 which includes barrel 28, front sight assembly 30, hand guards 31, and top carrier 32. At the rearward end of the barrel are chamber 33 and bolt 35, bolt key 36, cam 37, firing pin 38 and bolt body 40.

Bolt key 36, as best seen in FIG. 3, is modified from the prior art. The bolt key 36 is secured to the bolt 35 itself by retaining Allen set screws 41 and 42. The bolt key 36 has suitable holes drilled therein and the bolt 35 itself has tapped holes formed therein so that the said screws 41 and 42 can securely lock the bolt key 36 to the bolt 35.

Figure 6:
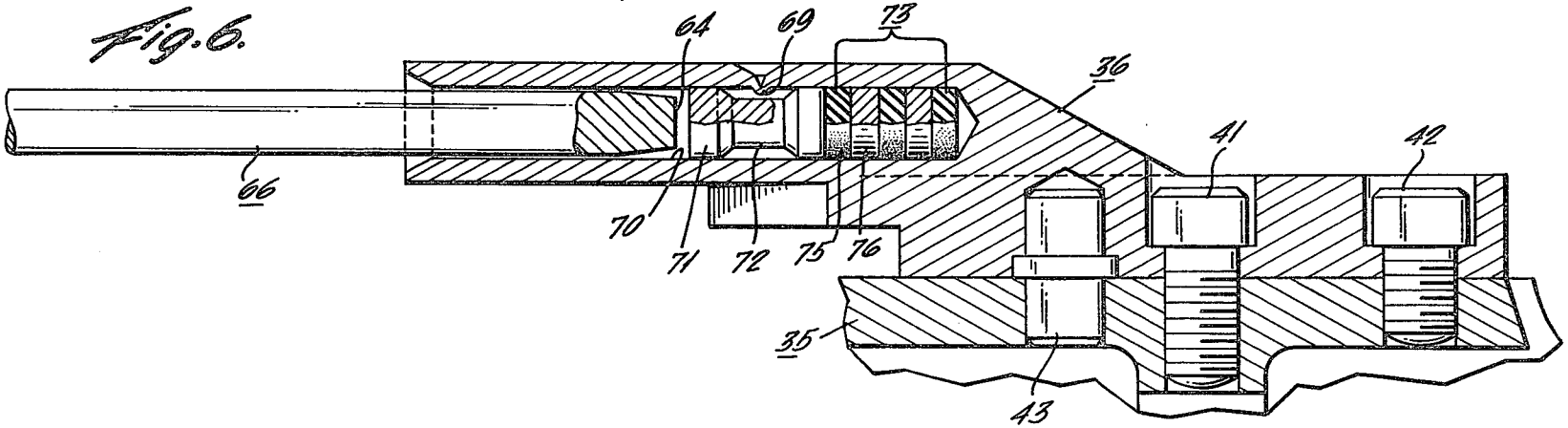
FIG. 6 is an enlarged fragmentary side elevation section view of the bolt carrier key assembly as shown in FIG. 1.

A shear pin 43 is inserted between bolt key 36 and bolt 35, as best seen in FIG. 6, to both block the prior art gas porthole into the interior of the bolt whereby gas pressure in the prior art was transmitted thereto, and to secure the elements 35 and 36 together.

Figure 4:
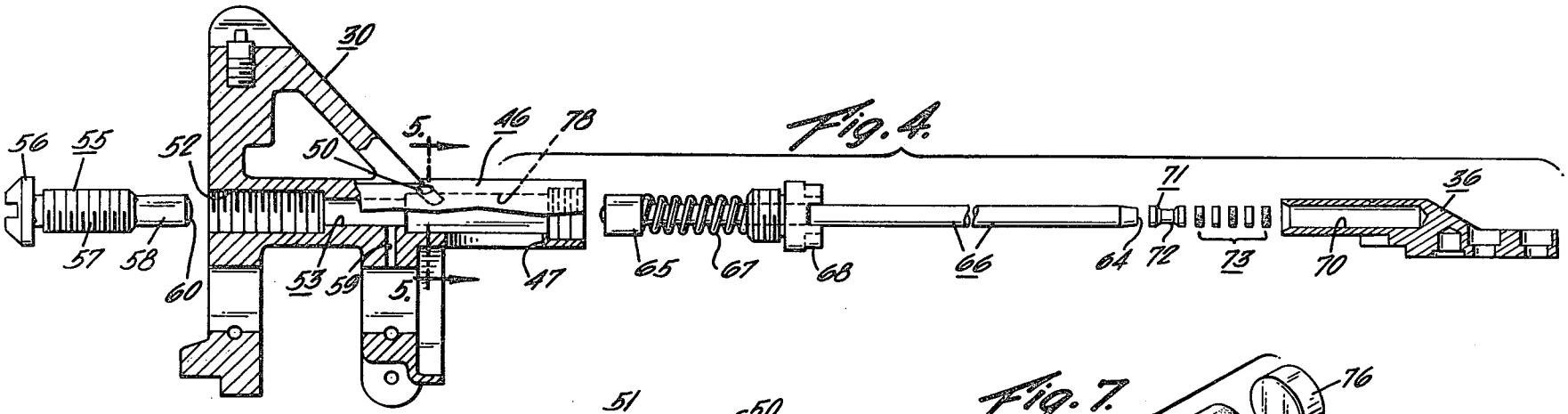
FIG. 4 is an exploded sectional side elevational view of the component parts of our invention showing the gas cylinder adjustment screw-front sight housing and combined gas chamber with associated ports, piston head, return spring, piston rod, buffer assembly and bolt carrier key.
Figure 5:
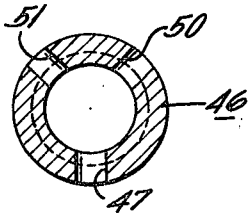
FIG. 5 is a transverse sectional view, taken on the line 5—5 of FIG. 4, showing the number and angular displacement of exhaust ports.

At the forward end of the barrel 28, front sight assembly 30 is secured thereto by two tapered dowl pins 45 as is well known. The front sight assembly 30 of the prior art is modified, as more clearly shown in FIGS. 4 and 5, to form therein a cylinder 46 having therein a lower longitudinally extending port or slot 47 and upper exhaust ports 50 and 51. A threaded tapered hole 52 extends through the upper sight to a smooth bore gas chamber 53. A blocking and adjusting screw 55 having a suitably slotted head 56 and threaded portion 57 integral with a smooth rearward portion 58, as best seen in FIG. 4. The end 60 of the adjustment screw 55 serves as a blocking surface for the front end of chamber 53 when screw 55 is threaded into tapered threads 52 as shown in FIGS. 1 and 2.

There extends a port 59 vertically within the front sight assembly 30 as best seen in FIG. 4. Such port 59 is for instance approximately ⅛" diameter and connects with port 62 in barrel 28. The front sight assembly 30 is so aligned and positioned on the barrel so that port 59 and 62 are in exact alignment.

Extending within cylinder 46 is piston 65 integrally connected to rearwardly extending piston rod 66. Piston 65 is of a suitable diameter to form a sliding fit within cylinder 46. A helically wound compression spring 67 extends around piston rod 66 and between piston 65 and retaining lock screw 68, as seen in FIG. 4.

The rearward end of the piston rod 66 extends into an inner bore 70 formed within bolt key 36. Piston rod 66 is free to slide within inner bore 70 in a manner to be explained later.

Figure 7:
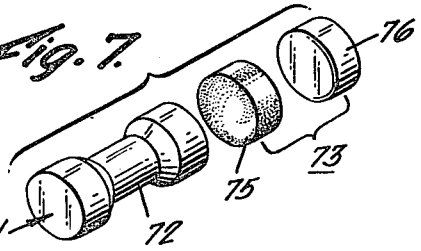
FIG. 7 is a pictorial view of the bolt carrier key buffer components showing only two of the five disks.

A floating piston 71 having a recessed portion 72, as best seen in FIG. 7, extends rearwardly of piston rod 66 within bore 70, as best seen in FIG. 6. A retaining dimple 69 formed in bolt key 36 will permit floating piston 71 to move longitudinally within limits, within the bore 70. Rearwardly of the floating piston 71 there extends a series of abutting shock-absorbing pads 73. As shown, there extends five (5) pads or disks, desirably of alternating different material such as neoprene pads 75 and steel 76.

In operation, the M-16 rifle is loaded in the prior art manner wherein a magazine having a plurality of projectiles is inserted into magazine housing 25. The initial loading of the weapon is done manually by retracting the bolt 35 against the prior art bolt return compression spring, not shown, extending rearwardly longitudinally within the stock assembly 21 of the rifle. The rifle is then in the condition shown in FIG. 1 wherein a projectile 26 is in chamber 33 ready to be fired. The bolt 35 is in a locked position as is well known.

In the modification of the invention, the piston rod 66 and piston 65 are in a forwardmost position under the bias of spring 67, against the shoulder which is at the rear of the chamber 53. Adjusting screw 55 is adjusted to provide a suitable fixed volume chamber 53 as seen in FIGS. 1 and 2, to receive propellant gases from the barrel, as will be later explained in more detail. The rearward end of piston rod 66 is in abutting relationship with floating piston 71 which in turn is in contact with shock-absorbing pads 73, within bolt key 36. The end of rod 66 extends in a sliding fit within bore 70 of bolt key 36.

The length of piston rod 66 and integral piston 61 is such that there is a slight space between the end of piston rod 66 and floating piston 71, as seen in FIG. 1. This space could be in the range of 0.030" and 0.040".

The rifle is ready to be fired at this point, as shown in FIG. 1. Upon firing, the firing pin 38 is released in the well known manner when trigger 24 is pulled, striking the primer in projectile 26. The propellant gases are ignited and rapidly burned forcing bullet 77 forward. At this point, of course, extremely high pressure is built up by the burning propellant powder. The powders are contained within the barrel 28 as the bullet 77 progresses forwardly. The bullet passes port 62 as is seen in FIG. 2. A portion of the propellant gases are forced through port 62 through 59 in upper sight assembly 30 into chamber 53. The pressure in chamber 53 forces piston 65 rearwardly within cylinder bore 78 of cylinder 46. As the piston rod 66 travels rearwardly, the end 64 of piston rod 66 slams against floating piston 71, compressing pads 73, and forcing bolt key 36 rearwardly. Since bolt key 36 is rigidly secured through Allen set screws 41 and 42, and shear pin 43, the rearward force exerted by rod 66 is transmitted to bolt 35. Bolt 35 moves rearwardly, unlocking prior art bolt locking mechanism, which includes cam 37, in the well known manner. The chamber 33 is then opened wherein the pressure within barrel 28 forces shell 26 rearwardly against the bolt 35 causing the bolt 35 to travel backwardly against bolt return compression spring. This step is the same as that of the prior art. The shell 26 is ejected and the bolt 35 at the end of its rearward travel is forced forwardly again by the bolt return compression spring into the position shown in FIG. 1, during which time a new projectile is placed into the chamber. Spring 67 returns piston rod 66 into its forward position as shown in FIG. 1.

The adjustment screw 55 is used to provide a variable volume chamber 53. The variable volume chamber permits an adjustment whereby varying rates of fire can be acquired, and also compensates for variations in powder charges and chamber pressures. For instance, where chamber pressures are relatively high and powder more quickly burning with resultant high pressure, the chamber is expanded so that less impact is exerted against piston 65. Where the powders may be more slow burning and chamber pressures lower, the chamber 53 may be reduced involume so that optimum action of the piston rod 66 and bolt 35 can be achieved.

Upper exhaust ports 50 and 51 in cylinder bore 78 are angled forward to prevent propellant gas exhaust from blowing back into the shooter's face. The ports are located forwardmost in cylinder bore 78 to immediately exhaust the gases and relieve gas pressure after the bolt 35 is unlocked. Complete dumping of gas is achieved through elongated slot 47. Elongated slot 47 also permits the easy self cleansing of cylinder bore 78.

In the operation as described above, the shell ejection is achieved in a smooth and controlled manner as opposed to the prior art gas ejection which is erratic due to uneven gas pressures which are directly transmitted.

In view of our invention, variations and modifications to meet individual whim or particular need will doubtless become evident to others skilled in the art to obtain all or part of the benefits of our invention without copying the structure shown, and we, therefore, claim all such insofar as they fall within the reasonable spirit and scope of our claims.

Having thus described our invention, what we claim as new and desire to secure by Letters Patent is:

1. A modification for a M-16 type standard U.S. Army rifle having among its elements a barrel and a bolt with a bolt key secured thereto, comprising:

(a) a forward cylinder connected to the front portion of the bore of the barrel wherein gas pressure from burning propellant powder is introduced, said cylinder having (1) adjustment means for varying the size of the bore of the cylinder whereby the force exerted by the propellant gases on the piston rod can be controlled, and (2) gas exhaust means;

(b) a piston within the cylinder;

(c) a rod connected to the piston extending rearwardly of the cylinder for transmitting force rearwardly to the bolt key; and (d) a buffer arrangement at the rearward portion of the piston rod and within the bolt key for absorbing the initial high impact force created by the gases in the forward cylinder which is transmitted rearwardly by the piston rod, said buffer system having a floating piston and a plurality of shock absorbing pads that are alternatingly different.

* * * * *